US006671991B1

(12) United States Patent
Danielson

(10) Patent No.: US 6,671,991 B1
(45) Date of Patent: Jan. 6, 2004

(54) TARGET ILLUMINATOR FOR LONG GUN

(76) Inventor: Lewis A. Danielson, 3225 SW. Riverwood, Portland, OR (US) 97225

( * ) Notice: Subject to any disclaimer, the term of this patent is extended or adjusted under 35 U.S.C. 154(b) by 0 days.

(21) Appl. No.: 10/188,429

(22) Filed: Jul. 3, 2002

(51) Int. Cl.[7] ..... F41C 3/14

(52) U.S. Cl. ..... 42/114; 42/117; 42/72; 89/41.17

(58) Field of Search ..... 42/114, 117, 115, 42/72; 89/41.17

(56) References Cited

U.S. PATENT DOCUMENTS

| | | | | | |
|---|---|---|---|---|---|
| 4,079,534 | A | * | 3/1978 | Snyder | 42/115 |
| 4,295,289 | A | * | 10/1981 | Snyder | 42/114 |
| 4,878,307 | A | * | 11/1989 | Singletary | 42/124 |
| 5,048,215 | A | * | 9/1991 | Davis | 42/72 |
| 5,299,375 | A | * | 4/1994 | Thummel et al. | 42/115 |
| 5,355,609 | A | * | 10/1994 | Schenke | 42/115 |
| 5,435,091 | A | | 7/1995 | Toole | |
| 5,481,819 | A | * | 1/1996 | Teetzel | 42/117 |
| 5,555,662 | A | * | 9/1996 | Teetzel | 42/115 |
| 5,622,000 | A | * | 4/1997 | Marlowe | 42/117 |
| 5,669,174 | A | * | 9/1997 | Teetzel | 42/115 |
| 5,983,774 | A | * | 11/1999 | Mihaita | 89/187.02 |
| 6,345,464 | B1 | * | 2/2002 | Kim et al. | 42/114 |
| 6,389,729 | B2 | * | 5/2002 | Rauch et al. | 42/72 |
| 6,568,118 | B1 | * | 5/2003 | Teetzel | 42/105 |

* cited by examiner

*Primary Examiner*—Michael J. Carone
*Assistant Examiner*—M. Thomson
(74) *Attorney, Agent, or Firm*—Langlotz Patent Works, Inc.; Bennet K. Lantlotz

(57) ABSTRACT

An illumination device for a firearm having a first hand grip position adjacent to a trigger and a second hand grip forward of the first grip position and having a gripping surface. The device has a first hand grip position adjacent to a trigger for a firearm with a second hand grip forward of the first grip position and having a gripping surface. An illumination source is connected to first the hand grip, and has an optical axis. The optical axis is positioned as an elevated level above a major portion of the gripping surface of the second hand grip, or above a horizontal plane defined by the axis of the barrel. The device may be a laser attached to an upwardly protruding portion of a protruding pistol grip, with an integral switch on the grip, or may be part of a conventional rifle butt stock, with the switch located on a narrowed portion of the stock.

38 Claims, 6 Drawing Sheets

TARGET ILLUMINATOR FOR LONG GUN

FIELD OF THE INVENTION

This invention relates to firearms aiming devices, and more particularly to laser sights for long guns.

BACKGROUND AND SUMMARY OF THE INVENTION

Firearm-mounted illuminators or laser sights have proven effective for aiming firearms in many applications. This includes handgun grip-mounted laser devices such as that disclosed in U.S. Pat. No. 5,435,091, entitled Handgun Sighting Device, the entire disclosure of which is incorporated herein by reference. The terms illuminator and sights are used interchangeably to refer to narrow beam aiming devices, and also to broad-beam illumination devices such as firearm-mounted flashlights used for illuminating dark spaces for navigation, or for identifying targets. These terms may also include broad and narrow beam infrared and other wavelength emitters used to identify or aim using night vision devices.

Laser sights and illuminators are well known for use on long guns such as tactical rifles and shotguns employed by military and police agencies. Such devices are normally mounted at the forward end of a long gun, forward of the forearm or grip surface where the user's weak or non-trigger hand rests. For convenient control, a switch is mounted near the device, and operable by the user applying pressure with the forward hand.

While effective in some instances, the forward mounted devices have the disadvantage in that they require two hands for operation: one to operate the trigger, and one to operate the laser device. This renders the operator less effective in instances in which it might be strategically advantageous to have a free hand for operating or carrying other equipment, for feeling a path in a dark or obscured place, or when one hand is injured.

Grip-mounted laser sights for handguns are operable with one hand, by using a pressure switch on the grip, and thus freeing the second hand for other tasks. However, these devices are unsuitable for use on long guns where the weak hand normally grips the forward portion of the gun, and thus would tend to obstruct the laser beam. The option of positioning the laser device at the front of the gun, and the switch at the rear of the gun would permit one-handed operation, but would require either a specially manufactured gun with imbedded or protected switch wires, or the substantial risk that exposed wires extending from the front to the hand grip would be susceptible to damage during rough operation, including operation of exposed bolt or pump action handles. The option of positioning an illuminator above the axis of a gun barrel in the position of a rifle scope is disadvantageous because it obscures the conventional mechanical "iron" sights of the gun, or at least renders them less effective for rapid target acquisition in critical circumstances, partially blocking the user's view of the target. Other optical sighting systems may likewise be obscured. The present invention overcomes the limitations of the prior art by providing an illumination device for a firearm. The device has a first hand grip position adjacent to a trigger for a firearm with a second hand grip forward of the first grip position and having a gripping surface. The device includes a first hand grip operable for connection to the gun at the first hand grip position. An illumination source is connected to first the hand grip, and has an optical axis. The optical axis is positioned as an elevated level above a major portion of the gripping surface of the second hand grip, or above a horizontal plane defined by the axis of the barrel. The device may be a laser attached to an upwardly protruding portion of a protruding pistol grip, with an integral switch on the grip, or may be part of a conventional rifle butt stock, with the switch located on a narrowed portion of the stock.

DETAILED DESCRIPTION OF A PREFERRED EMBODIMENT

Figure 1:
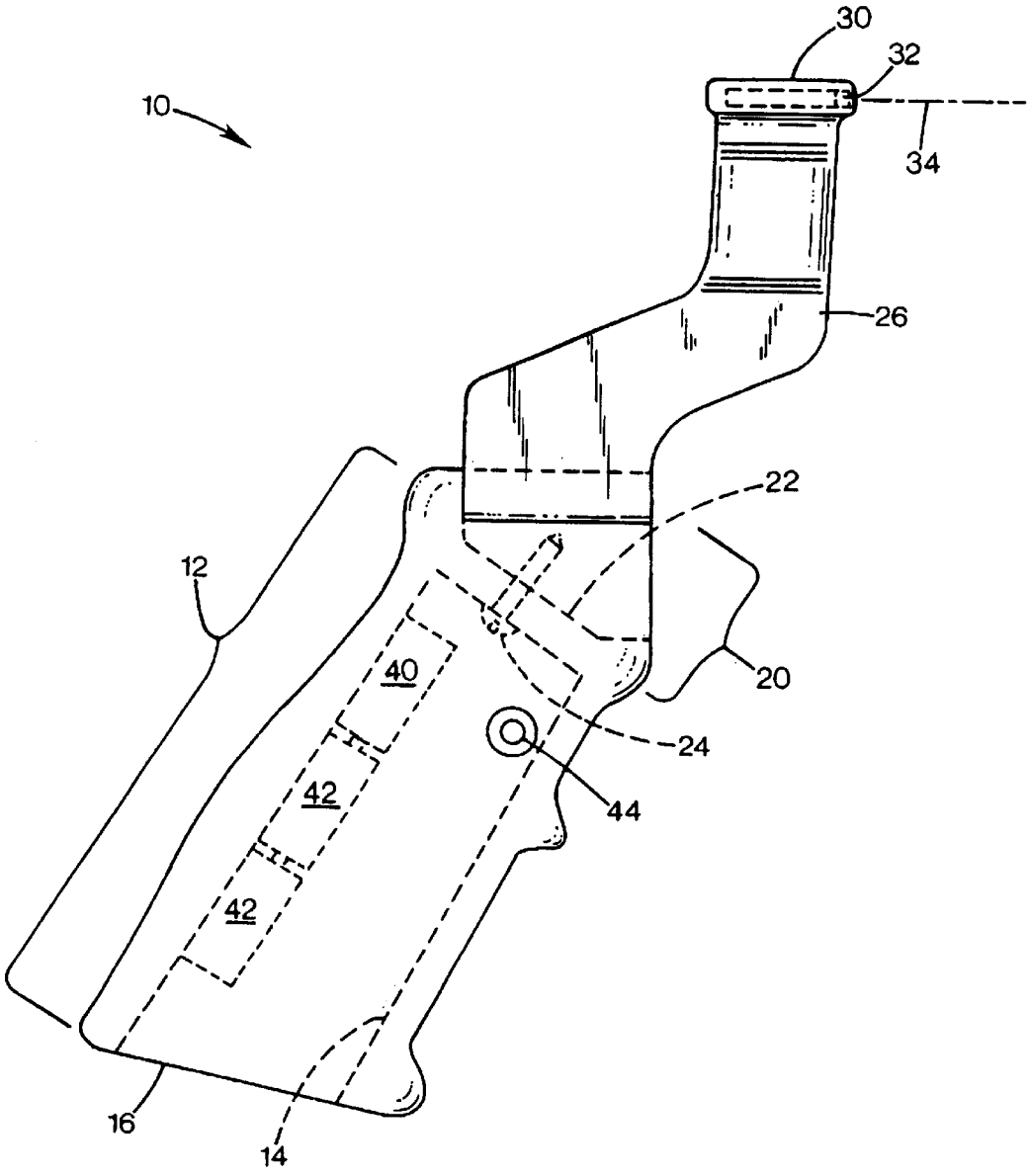
FIG. 1 is a side view of a grip mounted illuminator device according to a preferred embodiment of the invention.

FIG. 1 shows a pistol-style grip and laser aiming device assembly 10 for a long gun. For the purposes of this disclosure, a long gun includes all firearms with separate grips for each hand, one near the trigger for the primary or strong hand that operates the trigger, and one grip forward of the trigger for the secondary of weak hand. This includes rifles and shotguns as defined under US law as meeting the statutory minimum overall (26 inch) and barrel (16 or 18 inch) length regulations for civilian purchase, as well as other shorter firearms defined as short barreled rifles (SBR) and "Any Other Weapon" (AOW) that have the separate gripping locations common to rifles. This is in contrast to pistols, which have a single handle for gripping by one or both of the user's hands.

The device includes a handle grip portion 12 that has the same form, fit, and function of a conventional grip for an M-16 or AR-15 rifle, except in certain important respects discussed below. Other embodiments would be in the form of grips or stocks for any of the multitude of past, present, or future firearms, with comparable additional features as below. Other grips may be specially designed in ways that differ from conventional or original equipment stocks, based on demand for features in aftermarket products. Still others may be designed integrally with entire firearms, instead of as detachable grips.

The grip portion is a generally hollow cylindrical body defining a chamber 14 open at a butt end 16 of the grip. An upper end 20 of the grip portion includes a slot 22 for receiving a frame portion of the firearm, and a screw 24 is used to secure the grip to the firearm frame. A support arm 26 integrally molded with the grip portion 12 extends upward from the grip on one side, and terminates at an upper free end 30. A laser illuminator module 32 is received in the free end, and defines a beam axis 34 along which a laser beam is projected to generate a small spot of light on a distant target. In alternative embodiments, the laser may be replaced with a flashlight-type illuminator for illuminating dark spaces to aid navigation, by a broad-band narrow beam illuminator for aiming assistance, or by an infrared light source of any type for aiming or navigation with the aid of a night vision device. In addition, any forward-looking transmitter, emitter, receiver or collector may be 20 employed, including ranging devices using electromagnetic or ultrasonic energy, and imaging devices such as miniaturized video or still cameras for recording combat activity.

The laser is electrically connected to electrical circuitry and components stored within the handle. A control circuit 40 is connected to the laser, to a set of batteries 42, and to a manually actuated control switch 44 mounted on the exterior of the grip for activation by the user applying pressure with a finger or other portion of the trigger hand. The electrical components are interconnected by conductors (not shown) that may pass through passages in the grip, or which may be integrally molded within the grip. In the preferred embodiment, the grip is molded of a fiber reinforced thermoplastic such as glass-reinforced nylon.

Figure 2:
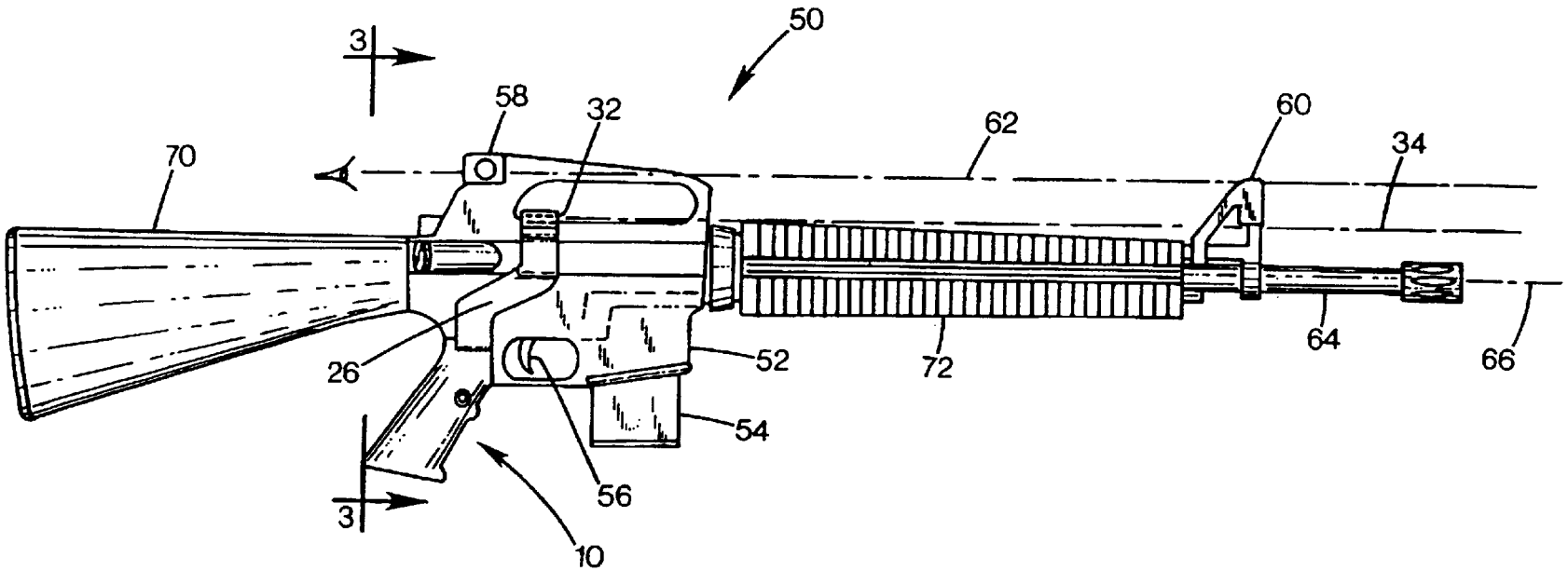
FIG. 2 is side view of a rifle on which is mounted the device of FIG. 1.

FIG. 2 shows the grip assembly 10 connected to a rifle 50. In this example, the rifle is an M-16 or AR-15 type, although this may be applied to any rifle or shotgun, including auto-loaders, pump-action, lever-action, bolt-action, single-shot, with detachable or integral magazines, in military, hunting, or bullpup configuration, and including pistols having separate hand gripping surfaces for each hand. The rifle includes a receiver or frame 52, with an attached magazine 54, trigger 56, and mechanical or iron rear and front sights 58, 60 defining a sight line 62. In alternative embodiments, other sighting devices may be employed instead of or in addition to the iron sights (e.g. rifle scopes, red dot sights, night vision scopes, etc.) The rifle has a barrel 64 having a barrel axis 66 essentially parallel to the sight line (with a slight upward angle of the barrel to accommodate bullet drop at selected distances) and similarly essentially parallel to the laser optical axis 34. A buttstock 70 extends rearwardly from the frame 52, and a forward hand guard or forearm grip 72 surrounds the barrel between the frame and the front sight, to be gripped by a user's weak or non-trigger hand for stability during shooting.

Figure 3:
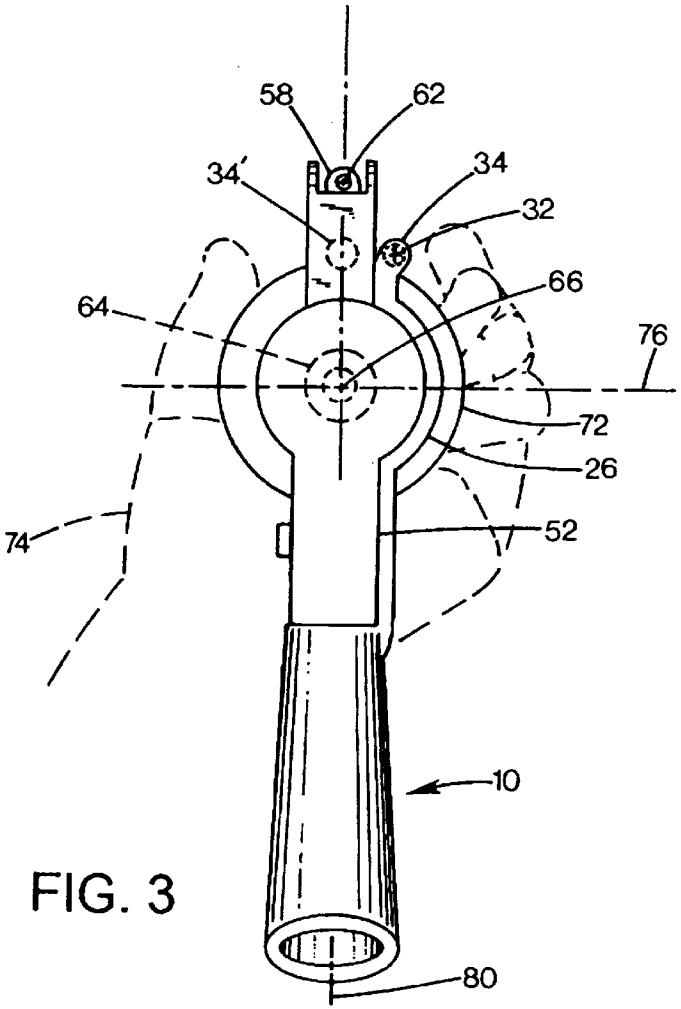
FIG. 3 is a sectional end view of the device of FIG. 1, taken along line 3—3 of FIG. 2.

The support arm 26 of the grip 10 extends up the side of the receiver, wrapping closely about the contours of the receiver. Preferably, the arm is slightly biased inward against the receiver to clamp it against the receiver when it is tightly secured in place, to prevent rattling or vibration. This is shown in FIG. 3, which illustrates how the shooter=3 s front hand 74 grips the forward grip 72. The barrel 64 defines a horizontal barrel plane 76, with the laser axis 34 positioned well above the barrel plane. The laser 32 is positioned adjacent to the sight 58, so that the laser axis 34 is reasonably close to the sight line axis 62 to provide comparably accurate targeting.

In alternative embodiments, the laser axis may be anywhere above the barrel plane, to ensure that a support hand does not block the laser beam. In the illustrated embodiment, the forward hand grip 72 is centered on the barrel, so that the laser is also positioned above at least a major portion of the hand grip as well. The laser axis is offset laterally from a medial plane 80 of the rifle by a minimal amount, so as to avoid obscuring the sight line 62, but without excessive offset to generate parallax errors or offset errors at close range. In an alternative embodiment, the laser may be centered on the medial plane at an alternate position 34', which would require drilling of the sight support elements to provide a clear optical path.

Figure 4:
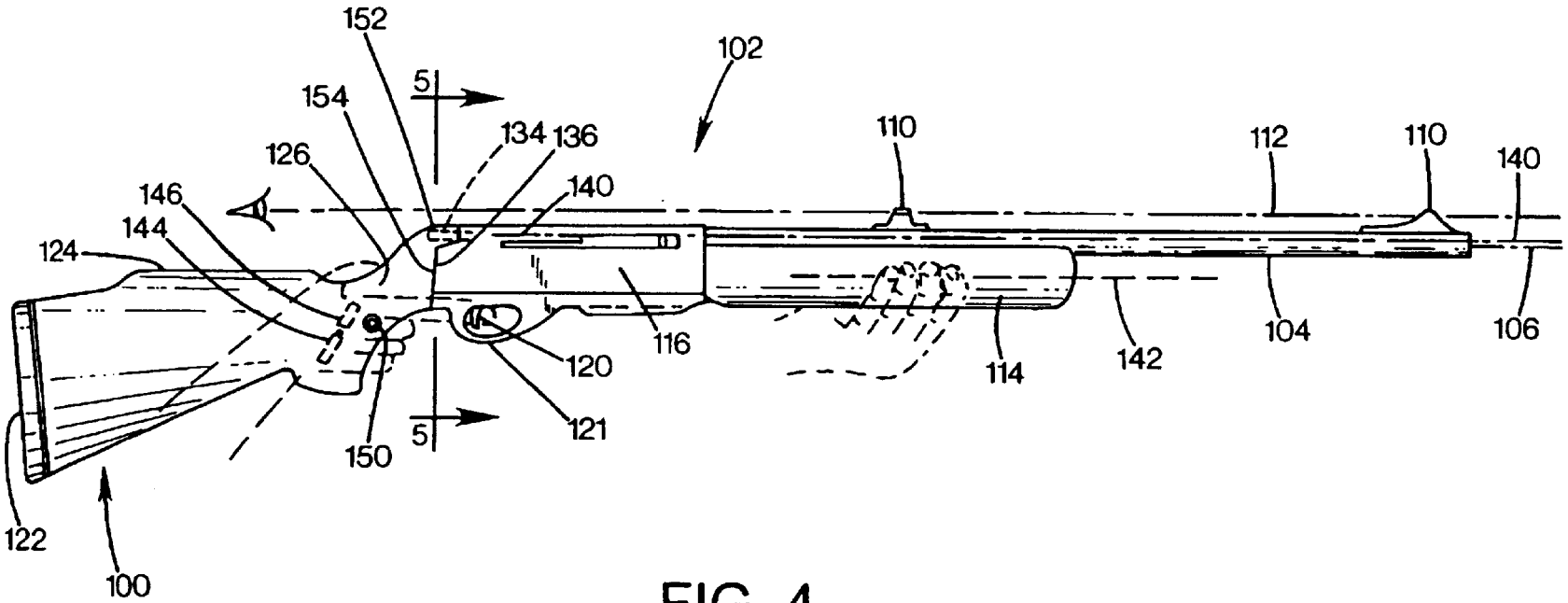
FIG. 4 is a side view of a first alternative embodiment of the invention.

FIG. 4 shows an alternative embodiment of the invention in which a buttstock 100 is connected to a firearm 102 such as a rifle or shotgun in a conventional non-military or hunting style configuration. The firearm is a long gun having a barrel 104 defining a barrel axis 106, sights 110 defining a sight axis 112, a forward hand grip 114 connected to a receiver or frame 116 with an attached trigger 120 protected by a trigger guard 121.

The buttstock is a molded polymer unit that includes a rear end 122 for resting against the shooter's shoulder, and a cheek rest surface 124 against which the shooter=3 s cheek rests for shooting stability and sight alignment repeatability. The stock has a narrowed portion 126 that serves as a rear handgrip about which the user wraps his trigger hand, with his index finger free to operate the trigger which the remaining digits are free to grip, carry, lift, hold, and stabilize the rifle as needed. A laser illuminator 134 is molded or inserted within the buttstock at a forward end portion 136 of the buttstock adjacent to the receiver 116. The illuminator 134 defines a laser axis 140 that is at a level above the barrel axis 106, and above a horizontal mid-line plane 142 of the forward grip surface. The buttstock contains connected circuitry 144, batteries 146, and a switch 150. The laser element 134 is contained in a forwardly protruding portion 152 that extends forward of the rear end 154 of the receiver. In alternative embodiments, the laser need not protrude forward, although it needs to protrude laterally enough for the beam to bypass the frame.

In alternative embodiments, the grip may extend upward farther above the laser axis, and cover more of the barrel, so that the invention applies to instances in which the laser axis is above most (at least about 50%, to provide adequate gripping area), but not all, of the grip surface. In these instances, the laser should be above at least half of the grip surface, or above a plane midway between the highest and lowest points of the forward gripping surface, to allow adequate support surface for a shooter to support the firearm without block the laser path.

The FIG. 4 embodiment may be modified for use with a rear pistol grip such as used with certain shotguns.

Figure 5:
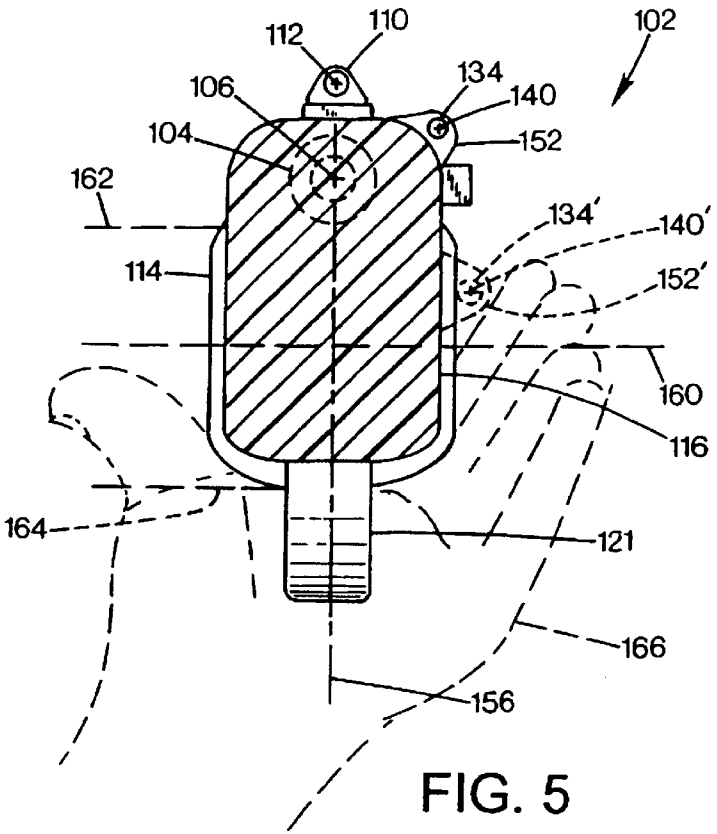
FIG. 5 is a sectional end view of the embodiment of FIG. 4, taken along line 5—5 of FIG. 4.

FIG. 5 is a sectional view through the receiver (internal detail omitted) at its rear end, so that the buttstock protrusion 152 and laser element 134 are the only stock portions shown. As in essentially all firearms, the sight axis 112 is vertically above the barrel axis 106, both in the medial plane 156. The laser axis 140 is laterally offset from the medial plane by a limited amount, and is positioned above the grip 114 and barrel axis.

FIG. 5 shows an alternative embodiment location for the laser element 134', within a buttstock protrusion 152' at the side of the receiver, well below the top of the receiver. This low position of the laser axis 140' is useful for certain application in which the upper position is unsuitable due to sights, riflescope mounts, ejection ports, operating handle, and the like. The laser axis 140' remains above a horizontal plane 160 that is halfway between an upper plane 162 and lower plane 164 that define the upper and lower limits of the gripping surface. This allows adequate room for a support hand 166 in certain applications.

Figure 7:
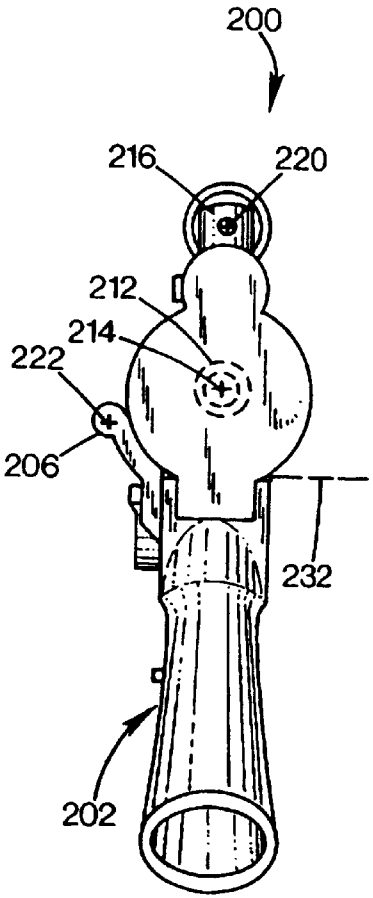
FIG. 7 is a rear end view of the embodiment of FIG. 6.
Figure 6:
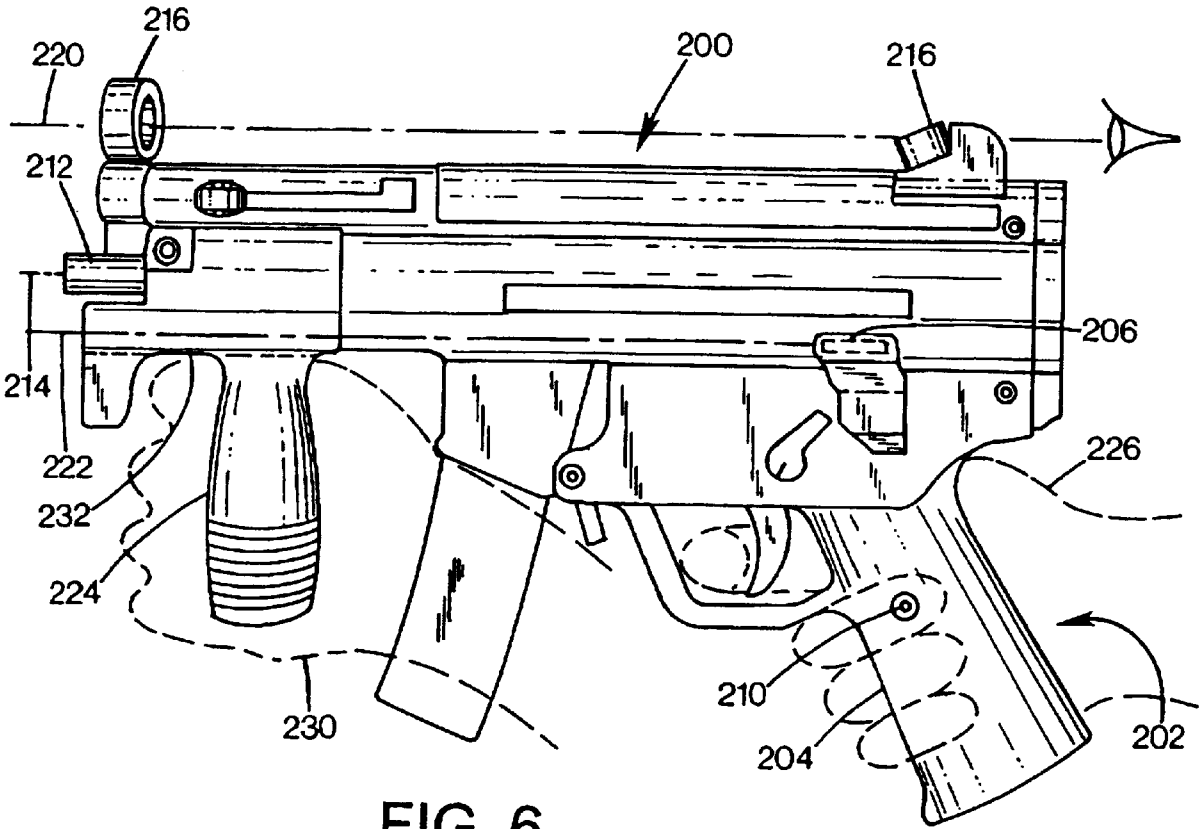
FIG. 6 is a side view of a second alternative embodiment of the invention.

FIGS. 6 and 7 illustrate another alternative embodiment shown a firearm 200 having a rear grip assembly 202 having a protruding pistol grip portion 204 with a laser unit 206 mounted in an upper portion, with internal circuitry and components (not shown) operable by a switch 210. The firearm has a barrel 212 defining an axis 214, sights 216 defining a sight axis 220, and the laser 206 defines a laser axis 222. The firearm, shown without an optional buttstock, has a downwardly protruding prominent forward grip 224 that extends perpendicularly to the barrel axis, generally parallel to the rear grip 204. The laser axis is positioned well above the level needed to avoid conflict with the rear hand 226 of the user, because the user=3 s forward hand 230 naturally rests at a higher level limited by the lower surface 232 of the frame of the firearm or grip assembly. Thus, the laser axis is above the level of the entire gripping surface in this embodiment, even though it is well below the axis of the barrel.

Figure 9:
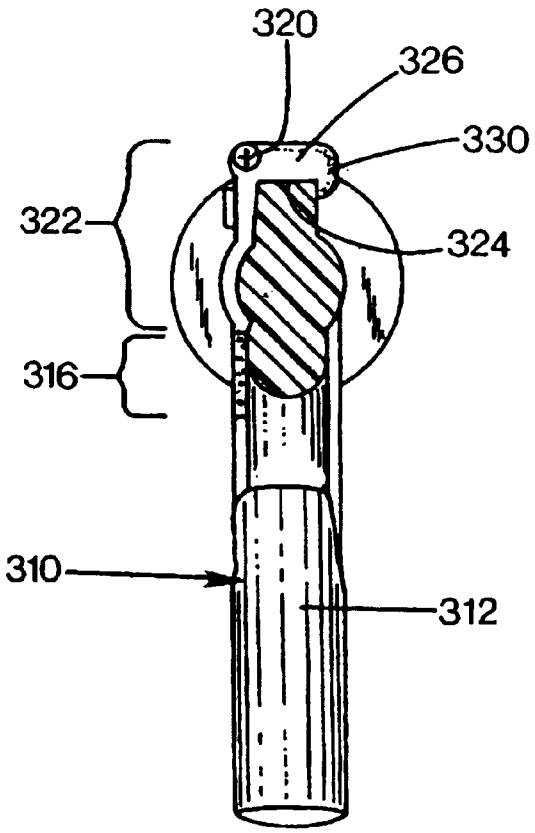
FIG. 9 is a sectional rear end view of the embodiment of FIG. 8.
Figure 8:
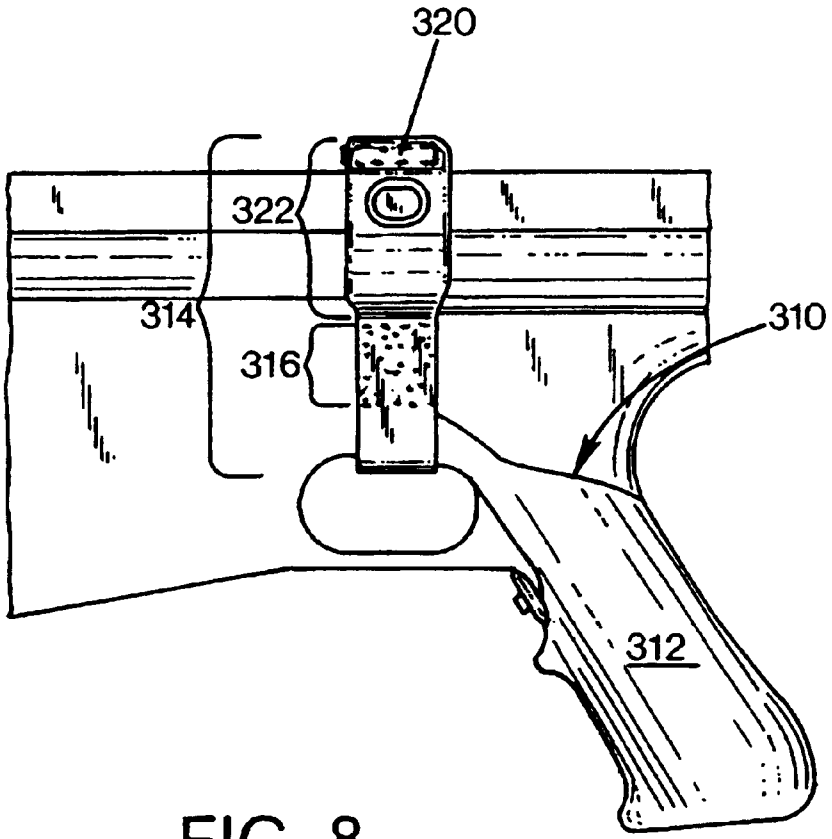
FIG. 8 is a side view of a third alternative embodiment of the invention.

FIG. 8 shows a pistol-style grip and laser aiming device assembly 310 for a long gun such as illustrated in FIG. 2. The device 310 is similar to the device 10 of FIG. 1 at the grip 312, and in terms of internal functions. However, the device differs in that the vertical portion 314 that extends upward from the grip includes an elastomeric portion 316 that allows some stretching in a vertical direction. Wires (not shown) extending between circuitry in the grip and a laser 320 follow a serpentine path within the elastomeric portion to allow stretching without damage to the wires. A rigid upper laser support portion 322 supports the laser 320 extends over the top of the firearm frame as shown in FIG. 9. The laser support portion defines a downwardly open channel 324 that closely encompasses the top of the firearm receiver, with the elastomeric portion under slight tension when installed as shown, to prevent rattling as might occur with a loose connection. The portion 322 includes a lateral portion 326 extending laterally across the top of the receiver, and a hook portion 330 that depends downwardly therefrom on the side opposite the elastomeric portion 316. This prevents the upper portion from being pulled off the receiver under tension. The grip assembly is installed to the receiver conventionally, except that the elastomeric portion allows the upper laser support portion to flex laterally. The upper portion is then pulled upward, and the hook portion is passed over the receiver frame, until it snaps over the frame edge into position. Thus, the laser position is fixed with respect to the rifle.

While the above is discussed in terms of preferred and alternative embodiments, the invention is not intended to be so limited.

What is claimed is:

1. An illumination device for a firearm having a trigger for discharging the firearm and a barrel defining a barrel axis, the device comprising:

a hand grip operable for connection to the firearm;

an illumination source connected to the hand grip and defining an optical axis at a level above the barrel axis; and a mechanical support arm connected to tie hand grip and to the illumination source.

2. The device of claim 1 wherein the hand grip is a pistol grip protruding prominently from the firearm.

3. The device of claim 1 wherein the hand grip is a narrowed portion of a butt stock extending rearwardly from the firearm.

4. The device of claim 1 wherein the firearm defines a horizontal barrel axis plane when the gun is in a conventional upright position for operation, and wherein the optical axis is above the horizontal barrel axis plane.

5. The device of claim 1 wherein the illumination source is positioned laterally offset from a medial plane of the firearm.

6. The device of claim 1 wherein the firearm includes a second sighting device defining a sight axis, and wherein the optical axis is positioned adjacent to and laterally offset from the sight axis.

7. The device of claim 1 including a switch operably connected to the illumination source and positioned on the grip.

8. The device of claim 7 wherein the firearm has a trigger, and wherein the switch is positioned rearvardly of the trigger.

9. The illumination device of claim 1 wherein the support arm provides a mechanical support for the illumination source.

10. The illumination device of claim 1 wherein the support arm is integrally molded with the hand grip.

11. The illumination device of claim 1 wherein the support ann terminates in a free end, and the illumination source is received within the free end of the support arm.

12. The illumination device of claim 1 wherein the firearm includes a frame having a selected contour, and wherein the support arm wraps closely about the contours of the frame.

13. The illumination device of claim 1 wherein the support arm is adapted to be biased against the firearm when installed.

14. The illumination device of claim 1 wherein the support arm includes an clastomeric portion.

15. The illumination device of claim 14 including a wire following a serpentine path within the elastomeric portion.

16. The illumination device of claim 1 including a wire within the support arm.

17. The illumination device of claim 1 wherein the support arm is stretchable in a vertical direction.

18. The illumination device of claim 1 wherein the support arm has an upper portion defining a downwardly-open channel for receiving a portion of the firearm.

19. The illumination device of claim 18 wherein the support arm is adapted to provide downward tension on the upper portion.

20. An illumination device for a firearm having a first hand grip position adjacent to a trigger for discharging the firearm, and a second hand grip forward of the first grip position and having a gripping surface, the device comprising:

a first hand grip operable for connection to the firearm at the first hand grip position;

an illumination source structurally connected to the first hand grip;

the illumination source defining an optical axis; and the optical axis positioned as an elevated level above a major portion of the gripping surface of the second hand grip.

21. The device of claim 20 wherein the first hand grip is a pistol grip protruding prominently from the firearm.

22. The device of claim 20 wherein the first hand grip is a narrowed portion of a butt stock extending rearwardly from the firearm.

23. The device of claim 20 wherein the first hand grip includes an upwardly extending support to which the illumination source is attached.

24. The device of claim 23 wherein the support is integral with the first hand grip.

25. The device of claim 20 wherein the illumination source is positioned laterally offset from a medial plane of the firearm.

26. The device of claim 20 wherein the firearm includes a second sighting device defining a sight axis, and wherein the optical axis is positioned adjacent to and laterally offset from the sight axis.

27. The device of claim 20 including a switch operably connected to the illumination source and positioned on the first hand grip.

28. The device of claim 27 wherein the Firearm has a trigger, and wherein the switch is positioned rearwardly of the trigger.

29. The device of claim 20 wherein the optical axis is positioned entirely above the gripping surface of the second hand grip.

30. A firearm comprising:

a frame with a barrel and a trigger;

a first and grip connected to the frame adjacent to a trigger and a second hand grip having a grip surface forward of the first hand grip;

an illumination source proximate to the first hand grip and defining an optical axis at a level above at least a major portion of the grip surface of the second hand grip;

a switch operably connected to the illumination source and positioned on the first hand grip; and a support arm structurally connected to the hand grip and to the illumination source.

31. The firearm of claim 30 wherein the first hand grip is a protruding prominently pistol grip.

32. The firearm of claim 30 wherein the first hand grip is a narrowed portion of a butt stock extending rearwardly from the firearm.

33. The firearm of claim 30 wherein the illumination source is positioned laterally offset from a medial plane of the firearm.

34. The firearm of claim 30 wherein the firearm includes a second sighting device defining a sight axis, and wherein the optical axis is positioned adjacent to and laterally offset from the sight axis.

35. The firearm of claim 30 wherein the firearm has a trigger, and wherein the switch is positioned rearwardly of the trigger.

36. The firearm of claim 30 wherein the optical axis is positioned entirely above the gripping surface of the second hand grip.

37. The firearm of claim 30 wherein the second hand grip protrudes prominently from the firearm.

38. The firearm of claim 30 wherein the illumination source is a laser.

* * * * *